US006008773A

United States Patent [19]

Matsuoka et al.

[11] Patent Number: 6,008,773

[45] Date of Patent: Dec. 28, 1999

[54] REFLECTOR-PROVIDED DIPOLE ANTENNA

[75] Inventors: Tohru Matsuoka, Zama; Hiroyuki Arai, 615-11, Imajukuhigashicho, Asahi-ku, Yokohama-shi, Kanagawa-ken; Masayuki Nakano; Toshio Satoh, both of Tokyo, all of Japan

[73] Assignees: Nihon Dengyo Kosaku Co., Ltd., Tokyo; Hiroyuki Arai, Kanagawa-ken; IDO Corporation, Tokyo, all of Japan

[21] Appl. No.: 09/080,147

[22] Filed: May 18, 1998

[51] Int. Cl.[6] ..... H01Q 9/28

[52] U.S. Cl. ..... 343/818; 343/700 MS; 343/795; 343/818

[58] Field of Search ..... 343/818, 700 MS, 343/793, 817, 819, 820, 796, 806, 795

[56] References Cited

U.S. PATENT DOCUMENTS 4,097,866 6/1978 Borowick ..... 343/727
4,860,020 8/1989 Wong et al. ..... 343/828
5,061,944 10/1991 Powers et al. ..... 343/795
5,754,145 5/1998 Evans ..... 343/795

*Primary Examiner*—Don Wong
*Assistant Examiner*—James Clinger
*Attorney, Agent, or Firm*—Beall Law Offices

[57] ABSTRACT

The reflector-provided dipole-antenna shows outstanding performance in a wide frequency range and allows simultaneous transmission and reception at different frequencies. A dipole antenna element is provided at the back of a dielectric substrate set to the reflector surface. A parasitic element is provided on the front of the dielectric substrate, which is constituted by forming and protruding the central portion of a linear conductor forward in an almost trapezoidal shape, for example. The protruded portion is set to a position corresponding to the front of the feed point of the dipole antenna element and the portions of the said parasitic element towards the ends are set to positions corresponding to the rear of the dipole antenna element. A feed circuit provided on the face side of dielectric substrate is connected to a coaxial connector provided at the back of the reflector.

35 Claims, 22 Drawing Sheets

REFLECTOR-PROVIDED DIPOLE ANTENNA

BACKGROUND OF THE INVENTION

The present invention relates to a reflector-provided dipole antenna suitable for an antenna of a base station for mobile communication, or the like, for which broad-band characteristics and simultaneous transmission and reception are required.

For base stations for mobile communication, particularly for a cellular telephone system, a communication system with small radio zones is used. In such a system, the same frequency is reused in different radio zones in order to efficiently use the precious frequency resources and to cope with the extreme increase of subscribers.

In the cellular telephone system, the space diversity technique is generally used to improve the communication quality. As a result, however, the number of antennas installed at each base station increases. For decreasing the number of antennas, the same antenna is used in common for the transmission and reception in the uplink and downlink with different frequencies.

For this type of transmitting-receiving antenna, it is required to have as wide a frequency band as 810 to 960 MHz for the digital cellular telephone system, an example in Japan. Moreover, it is required that horizontal directivities for transmission and reception are almost identical in the uplink and downlink so that the service quality in both links is kept equal.

FIG. 20 is a perspective view showing a reflector-provided dipole antenna having been used so far as an antenna meeting this requirement, in which symbol 1 denotes a reflector and 2 denotes a dielectric substrate.

Symbol 3 denotes a conductor for forming a dipole antenna element and 4 denotes an earth conductor which is perpendicularly attached to the central portion of the said conductor 3. Both 3 and 4 are provided on the back surface of the dielectric substrate 2.

FIG. 21(*a*) shows an essential portion of the back side of the dipole antenna element and feed circuit. A notch 20 is formed at one side of the central portion of the conductor 3, dividing the conductor 3 into two, and forms a dipole antenna element. From the vertex of the notch 20, a slot 21 is formed on and along the earth conductor 4 for forming a feed circuit for the dipole antenna element. The intersection 22 of notch 20 and slot 21 is the feed point of the dipole antenna element.

FIG. 21(*b*) shows the face side of substrate 2. Symbol 5 denotes a folded conductor for forming a feed circuit and 16 denotes a parasitic element. The folded conductor 5 forms a micro-strip line balance-unbalance conversion circuit (BALUN) associated with the branch conductor formed by the divided portion of the earth conductor 4 provided on the back of the dielectric substrate 2.

The parasitic element 16 includes a linear conductor having a length a little shorter than $\lambda/2$, $\lambda$ being the designated radiation wavelength, and is set a little separated from and in parallel with the conductor 3, which forms a dipole antenna element as shown in FIG. 20. Those elements such as 5 and 16 formed on the face side of substrate 2 can be formed on the back side, provided that elements such as 3 and 4 on the back side are formed on the face side.

In FIG. 20, a coaxial connector (not shown in the figure) is provided on the back of the reflector 1. The inner conductor of the coaxial connector is made to pass through a hole provided on the reflector 1 and connected to the rear end of the folded conductor 5 so that it is not electrically connected with the reflector 11 and the outer conductor of the coaxial connector is connected to the rear end of the earth conductor 4 through the hole on the reflector 1.

In the case of this antenna, the resonance characteristics of the dipole antenna element including the conductor 3 is electromagnetically coupled with the resonance characteristics of the parasitic element 16 and broad-band characteristics are obtained based on the double-tuning principle.

FIG. 22 shows the frequency response of beam width (half power beam width) of the conventional antenna shown in FIGS. 20, 21(*a*) and 21(*b*) in the magnetic field plane (in the horizontal plane when the radiated wave is of vertical Polarization) for the case where the distance between the feed point and the reflection surface of the reflector 1 is approximately $0.3\lambda$, the length of the reflector 1 in the direction of electric field is approximately $1\lambda$, and the length of the reflector 1 in the direction of magnetic field on the reflector surface is approximately $0.6\lambda$.

In this figure, the x-axis shows the frequency (MHz) of the radiated wave and the y-axis shows the beam width (degree) in the magnetic field plane. From FIG. 22, it is found that there is a defect in that the beam width changes greatly in accordance with the change of frequency of the radiated wave.

In the case of the conventional antenna shown in FIGS. 20, 21(*a*) and 21(*b*), the parasitic element 16 is made so that the length of the element 16 is a little shorter than that of the dipole antenna element. Therefore, the conventional antenna resonates at a frequency higher than that of the dipole antenna element. Thus, the beam width decreases when the frequency of radiation wave is low because the parasitic element 16 serves as a director. When the frequency of radiation wave is high, large current flows through the dipole antenna element serving as the radiation center and the large current flowing through the dipole antenna element moves to the parasitic element and the beam width increases.

That is, the parasitic element of a conventional antenna is effective to widen the bandwidth of return loss but it is improper as a shared antenna for uplink and downlink having different frequencies like an antenna of a base station for mobile communication because the beam width greatly changes against the frequency change of radiation wave.

Moreover, in the case of a conventional antenna, the parasitic element must be placed a little separated from the dipole antenna element for keeping the wide band characteristic, and the height of substrate 2 from the reflector 1 becomes large. Therefore, the outside diameter of a cylindrical radome for covering the antenna must be increased and thereby, difficulty arises in selecting the place for antenna installation due to the increased weight, size, and wind load of the radome.

SUMMARY OF THE INVENTION

It is an object of the present invention to eliminate disadvantages of a conventional antenna by realizing a reflector-provided dipole antenna including:

- a dipole antenna element set to the back (or face) side of a dielectric substrate perpendicularly provided on the surface of a reflector;
- a feed circuit provided on the dielectric substrate; and a parasitic conductive element provided on the face (or back) side of the said dielectric substrate and constituted by setting a protrusion formed at the central portion of the parasitic element to a position corresponding to the front side of the feed point of the dipole antenna element and setting the linear portions of the parasitic element, towards both ends, to a position corresponding to the rear side of the dipole antenna element.

Other objects, features and advantages of the present invention will become more apparent in view of the following detailed description of the preferred embodiments in conjunction with the drawings.

DESCRIPTION OF THE PREFERRED EMBODIMENTS

Figure 1:
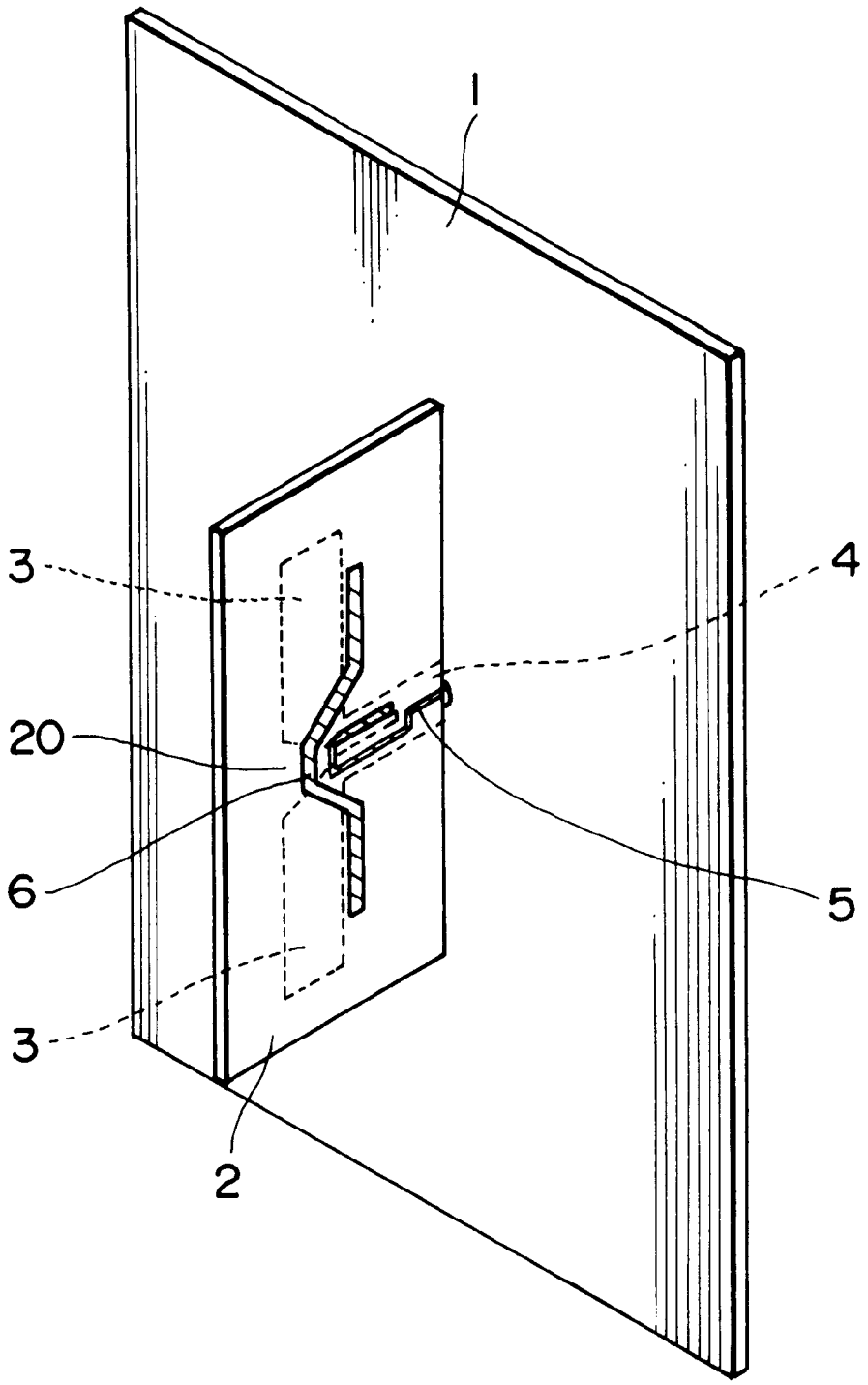
FIG. 1 is an embodiment of the present invention.

FIG. 1 is a perspective view showing an embodiment of the present invention, in which symbol 1 denotes a reflector and 2 denotes a dielectric substrate, and one edge of the dielectric substrate 2 is attached directly to the reflection surface of the reflector 1 or indirectly by means of a proper support so that the plane of the dielectric substrate 2 perpendicularly intersects with the reflection surface of the reflector 1. The conductor 3 for forming a dipole and the earth conductor 4 are provided on the back side of the dielectric substrate 2, on which, as shown in FIG. 2(*a*), a notch 20 is formed at the central portion of the front edge of the conductor 3.

Symbol 4 denotes an earth conductor which is perpendicularly attached to the central portion of the said conductor 3. Both 3 and 4 are provided on the back side of the dielectric substrate 2. FIG. 2(*a*) shows an essential portion of the back side of the dipole antenna element and feed circuit.

A notch 20 is formed at the front of the central portion of the conductor 3, dividing the conductor 3 into two, and forms a dipole antenna element. From the vertex of the notch 3 a slot 21 is formed on and along the earth conductor 4 for forming a feed circuit for said dipole antenna element. The intersection 22 of notch 20 and slot 21 is the feed point of the dipole antenna element. FIG. 2(*b*) shows the face side of substrate 2. Symbol 5 denotes a folded conductor for forming a feed circuit and 6 denotes a parasitic element. As shown in FIG. 1 and FIG. 2(*b*), elements 5 and 6 are provided on the face surface of the dielectric substrate. The folded conductor 5 forms a micro-strip line balance-unbalance conversion circuit (BALUN) associated with the branch conductor formed by the divided portion of the earth conductor 4 provided on the back surface of the dielectric substrate 2. The parasitic element 6 has linear conductors 25 towards its ends having a length a little shorter than $\lambda/2$, $\lambda$ being a designed radiation wavelength, and has a protruding portion 26 at the central portion of the conductor 6. This protruding portion generally resembles a trapezoid with one of the bases missing. In other words, the protruding portion resembles three sides of the trapezoid. The protruding portion 26 is set to a position corresponding to the notch 20 in FIG. 1 formed at the central portion of the conductor 3 for forming a dipole antenna element. This position corresponds to the upper part (in FIG. 1) of the feed point of the dipole antenna element. The linear portions 25 towards both ends of conductor 6 are set to positions corresponding to the rear edge of the conductor 3 for forming the dipole antenna element on the back side.

Figure 2A:
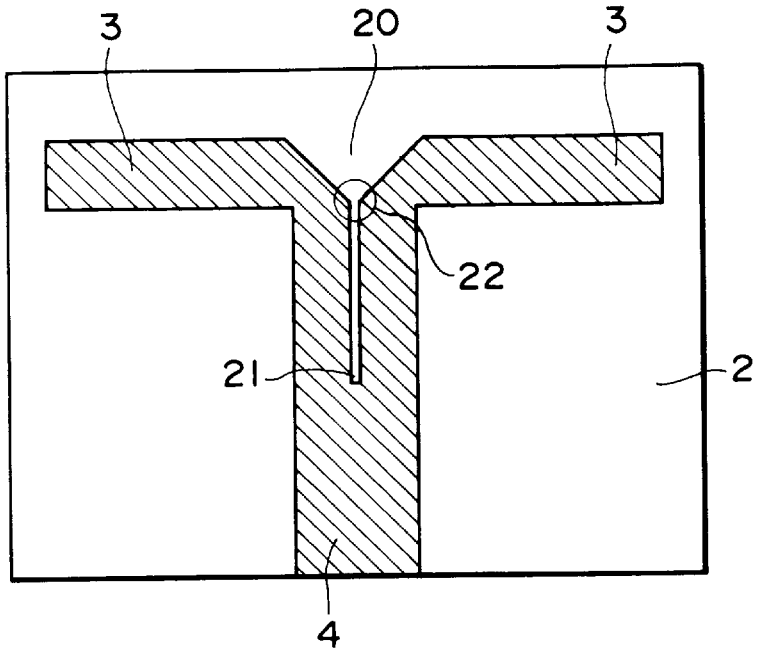
FIGS. 2(*a*) and 2(*b*) are essential portions of an antenna of the present invention.
Figure 2B:
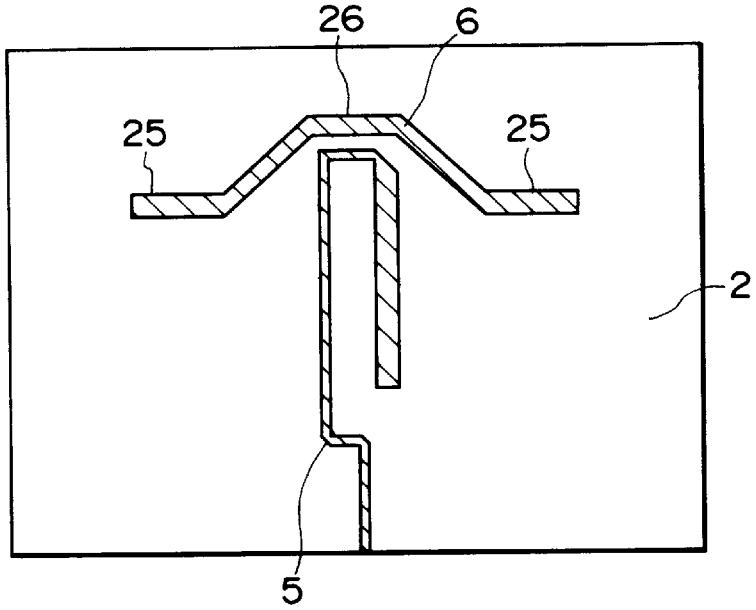

In this explanation, FIG. 2(*a*) is the back side of the substrate 2 and FIG. 2(*b*) is the face side. The face and back side can be interchanged, if necessary, achieving the same performance.

Moreover, though not shown in the figure, a coaxial connector is provided on the back of the reflector 1. The inner conductor of the coaxial connector is made to pass through a hole provided on the reflector 1 and connected to the rear end of the conductor 5 for forming the balance-imbalance conversion circuit (BALUN) so that the inner conductor is not electrically connected with the reflector 1, and the outer conductor of the coaxial connector is connected to the rear end of the earth conductor 4 through the hole on the reflector 1.

Figure 3:
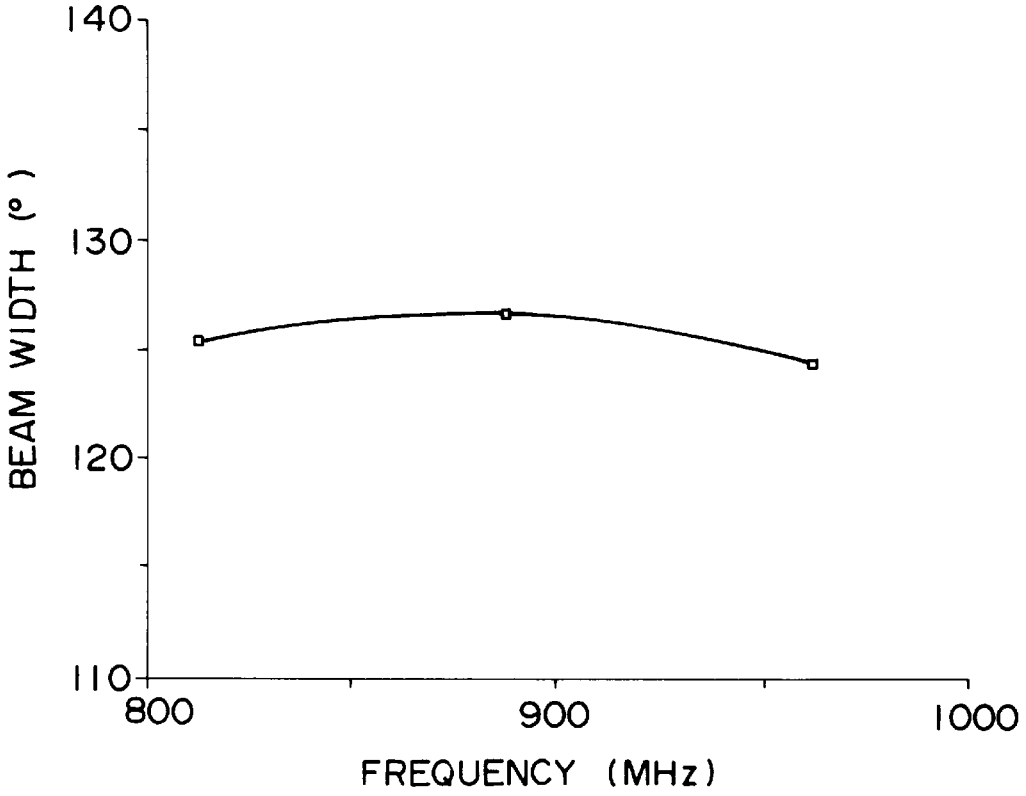
FIG. 3 is the frequency response of the beam width of an antenna of the present invention.

FIG. 3 shows the frequency response of beam width (half power beam width) of the antenna of the present invention shown in FIGS. 1 and 2 in the magnetic field plane (in the horizontal plane when the radiated wave is of vertical polarization) when setting the distance between feed point, or the vertex of notch 20, of the dipole antenna element and the reflection surface of the reflector 1 to approximately $0.3\lambda$, setting the length of the reflector 1 in the direction of electric field to approximately $1\lambda$, and setting the length of the reflector in the direction of magnetic field to approximately $0.6\lambda$. In this figure, the x-axis shows the frequency (MHz) of radiated wave and the y-axis shows the beam width (degree) in a magnetic field plane. From FIG. 3, it can be seen that the beam width is almost constant, independent of the frequency change of radiated wave. This is because, when the frequency of radiated wave is relatively high, a relatively large current is induced through the parasitic element 6 and the electrical distance (the distance in terms of radiated wavelength) between the reflection surface of the reflector 1 and the radiation center is kept almost constant.

Therefore, an antenna of the present invention is suitable for use as, for example, a transmitting-receiving antenna operating at different frequencies.

Figure 4:
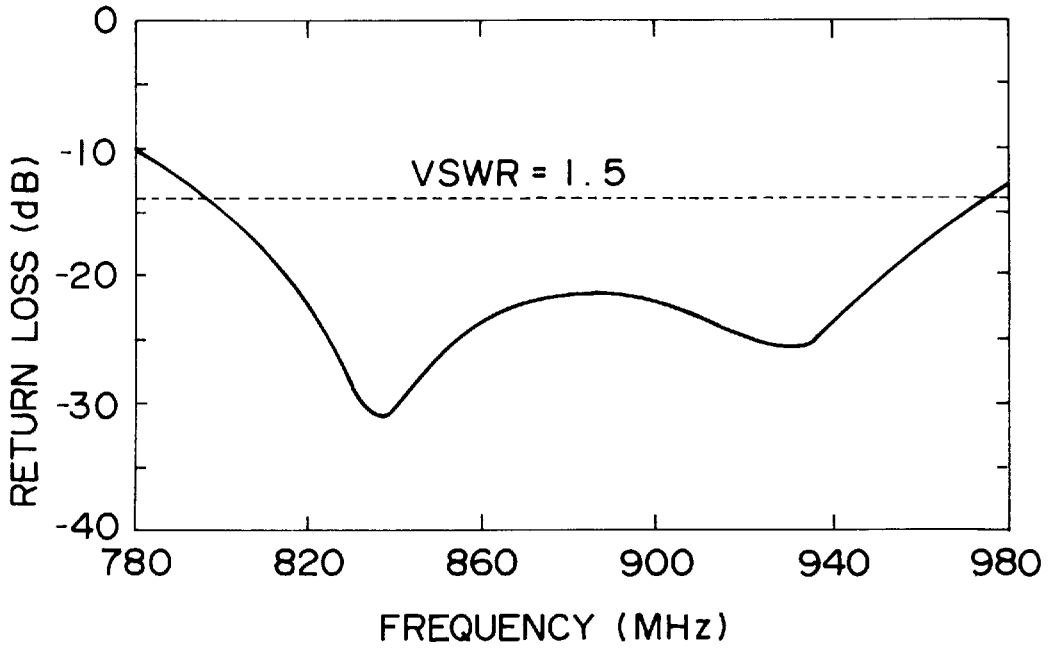
FIG. 4 is the frequency response of the return loss of an antenna of the present invention.

FIG. 4 shows the result of measurement of the reflection characteristics viewed from the coaxial connector (provided on the back side of the reflector 1 but not shown in the figure). The measurement was made in terms of frequency response of return loss. The x-axis shows frequency (MHz) of radiated wave and y-axis shows return loss (dB) in the case of the antenna of the present invention shown in FIGS. 1 and 2. From FIG. 4, it is found that the relative bandwidth of the voltage standing wave ratio (VSWR) at a value of 1.5 or less is approximately 20%. From this figure, it can be noted that the band widening is sufficiently achieved based on the double-tuning principle according to electromagnetic coupling between the resonance characteristics of a dipole antenna element formed by the conductor 3 and that of the parasitic element 6.

Figure 5A:
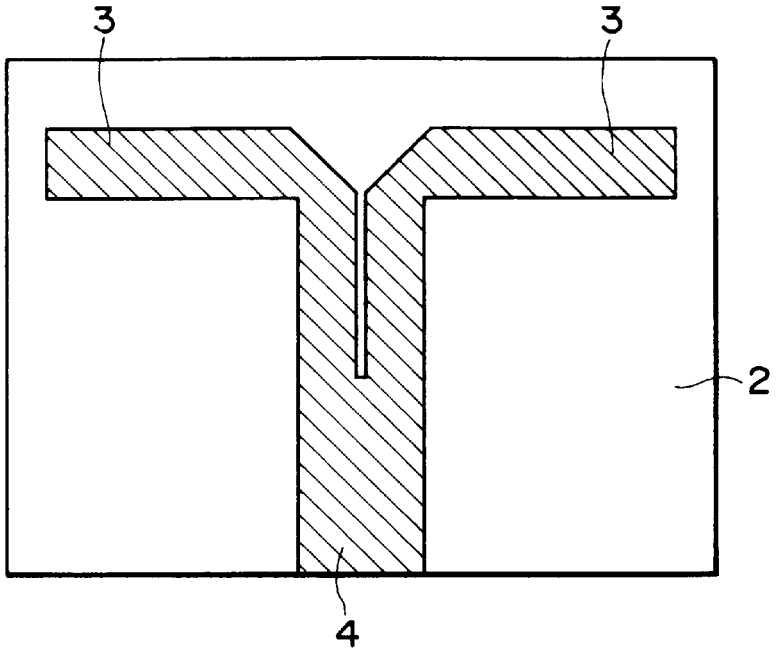
FIGS. 5(*a*) and 5(*b*) are essential portions of the optimum embodiment of the present invention.
Figure 5B:
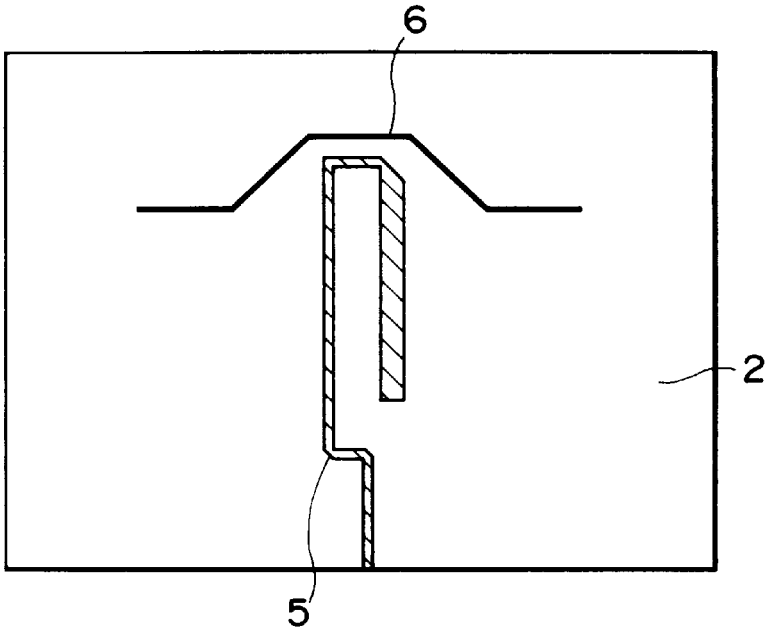

FIGS. 5(*a*) and FIG. 5(*b*) are simplified version of FIGS. 2(*a*) and FIG. 2(*b*), in which the parasitic element 6 is shown by a mere continuous line, as opposed to a shaded strip in FIGS. 2(*a*) and 2(*b*).

Figure 6A:
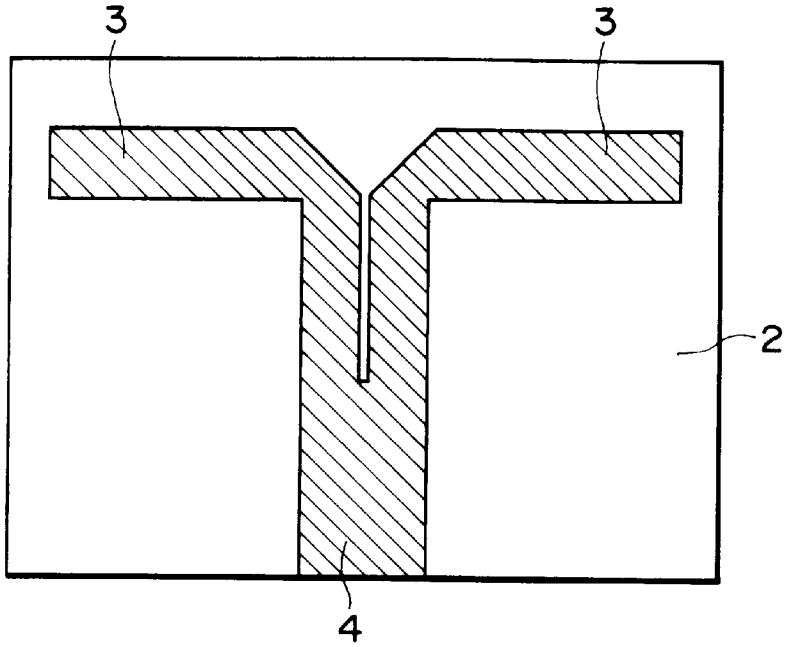
FIGS. 6(*a*) and 6(*b*) are essential portions of another embodiment of the present invention.
Figure 6B:
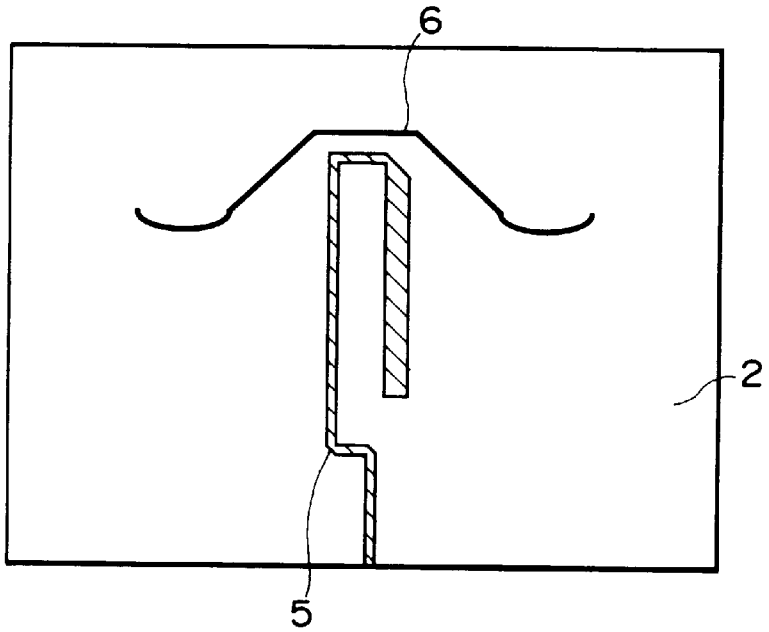
Figure 14A:
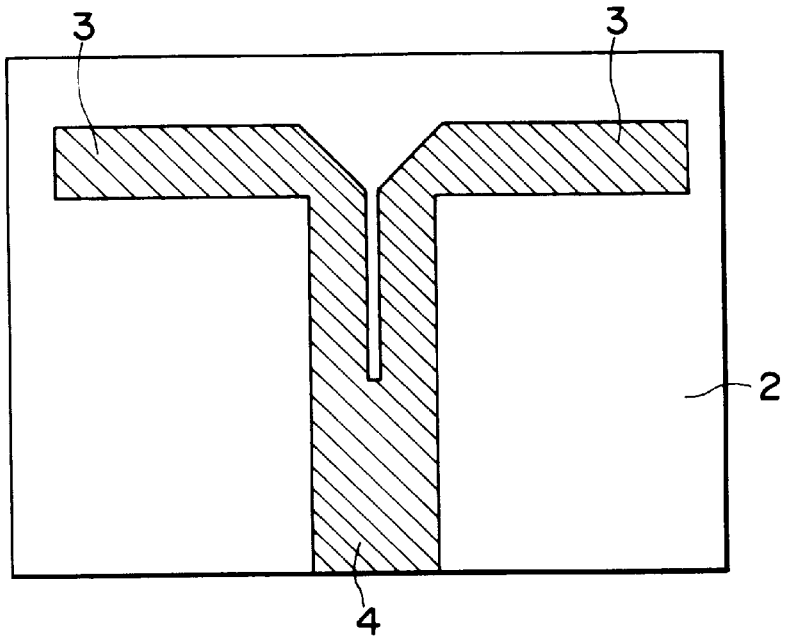
FIGS. 14(*a*) and 14(*b*) are essential portions of still another embodiment of the present invention.
Figure 14B:
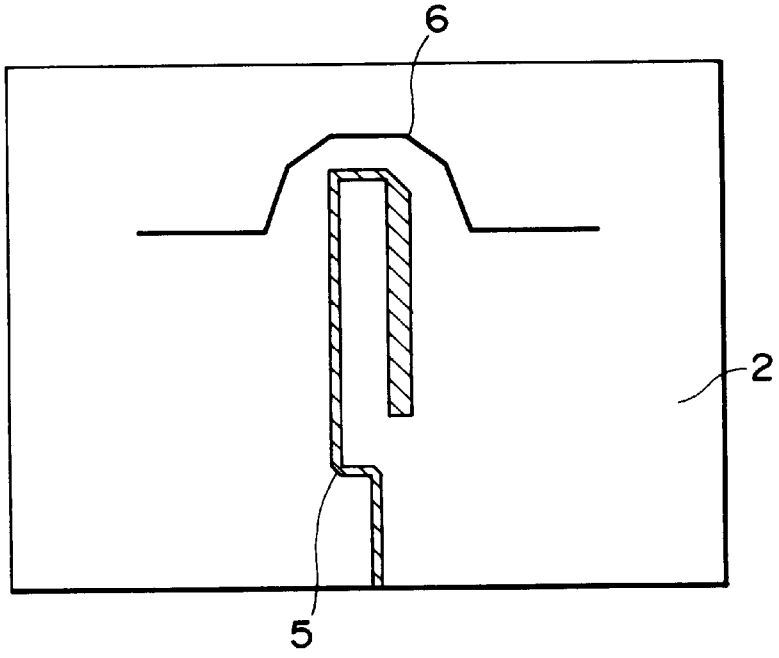
Figure 15A:
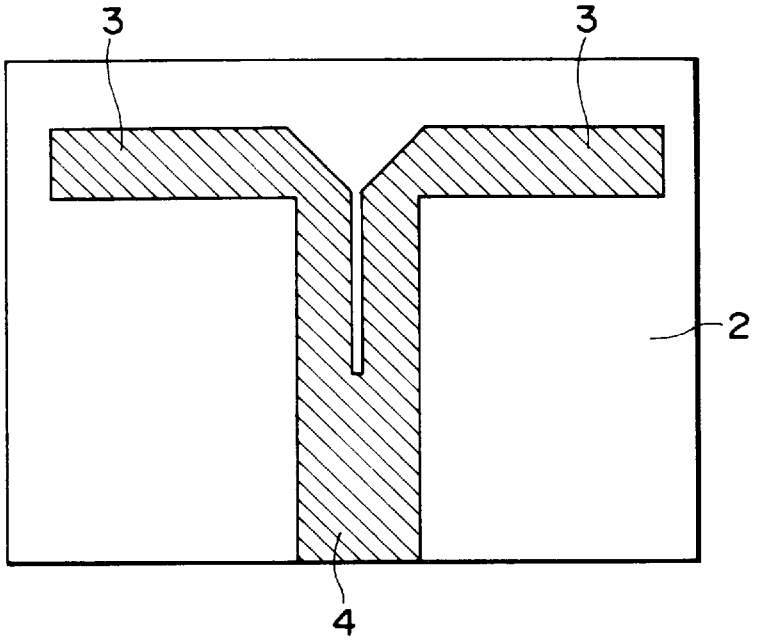
FIGS. 15(*a*) and 15(*b*) are essential portions of still another embodiment of the present invention.
Figure 15B:
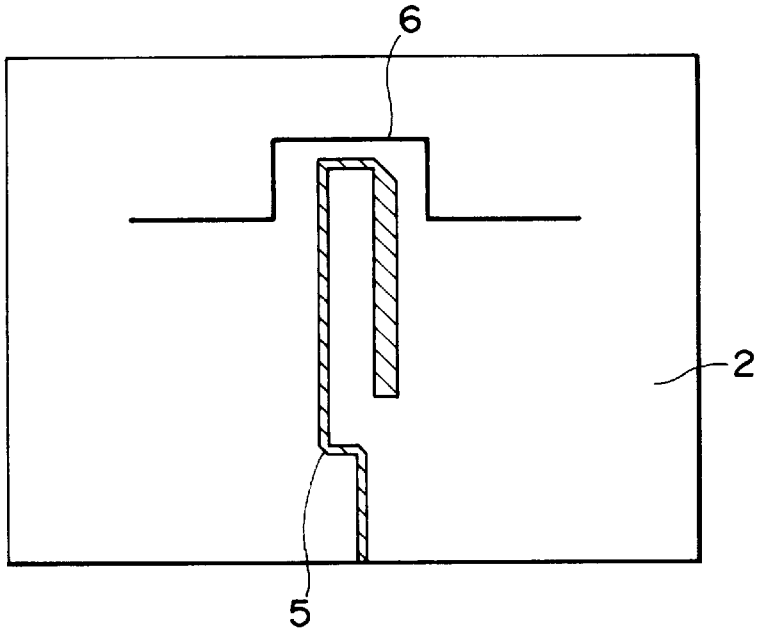

FIGS. 6(*a*) and 6(*b*) to FIGS. 15(*a*) and 15(*b*) are illustrations for explaining essential portions of other embodiments of the present invention (illustrations for explaining other embodiments of the parasitic element 6). The parasitic elements 6 in FIGS. 6 to 15 are shown in the same manner as the case of FIG. 5.

Figure 7A:
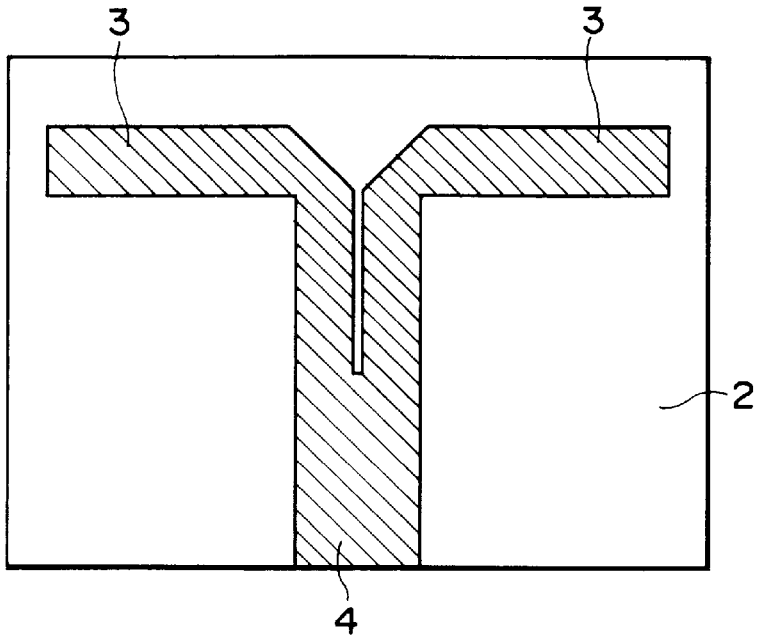
FIGS. 7(*a*) and 7(*b*) are essential portions of still another embodiment of the present invention.
Figure 7B:
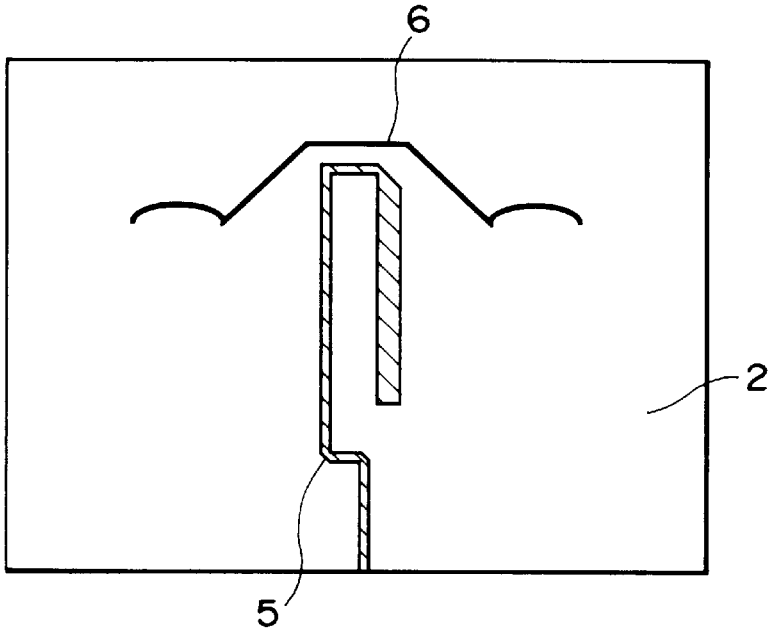
Figure 8A:
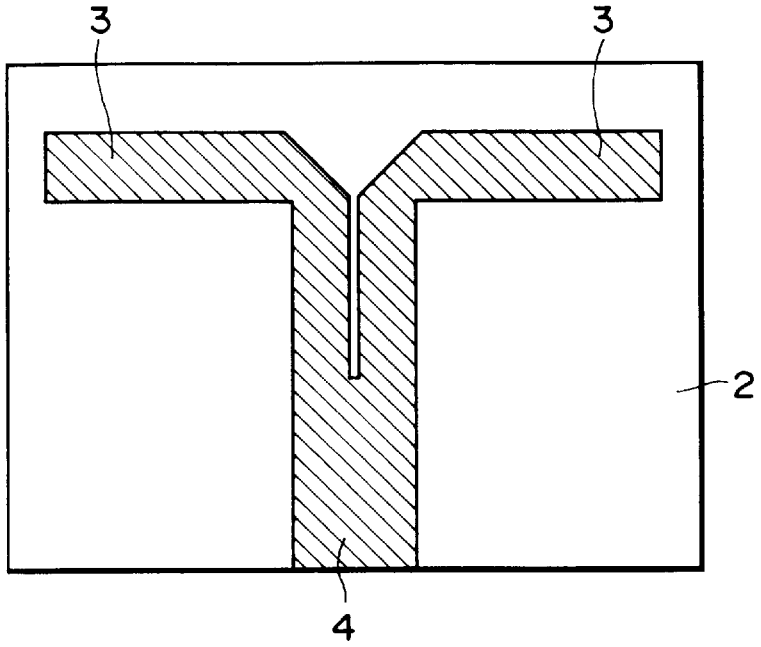
FIGS. 8(*a*) and 8(*b*) are essential portions of still another embodiment of the present invention.
Figure 8B:
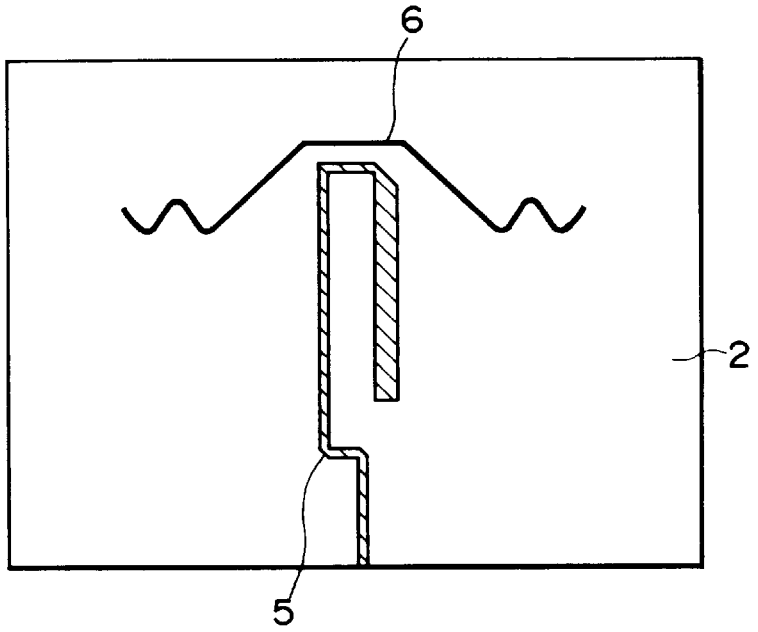
Figure 9A:
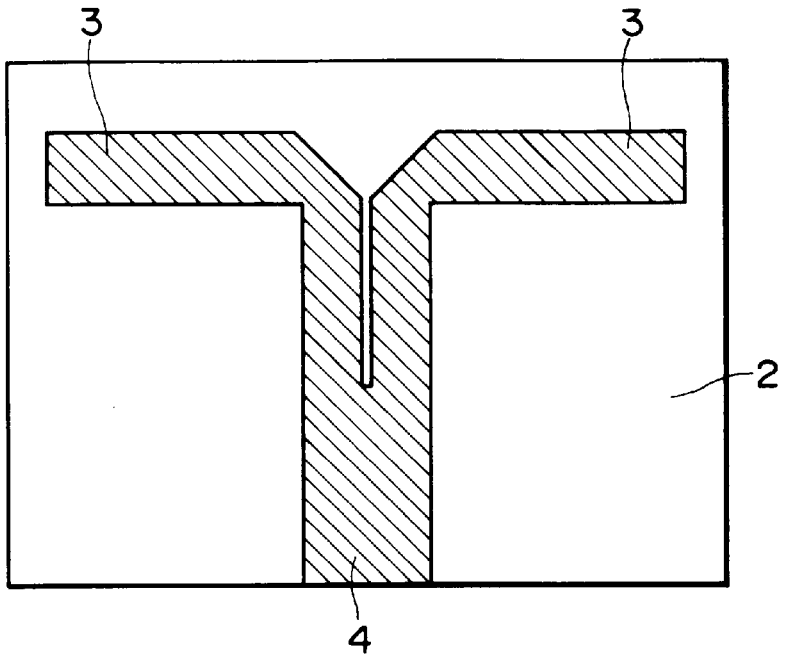
FIGS. 9(*a*) and 9(*b*) are essential portions of still another embodiment of the present invention.
Figure 9B:
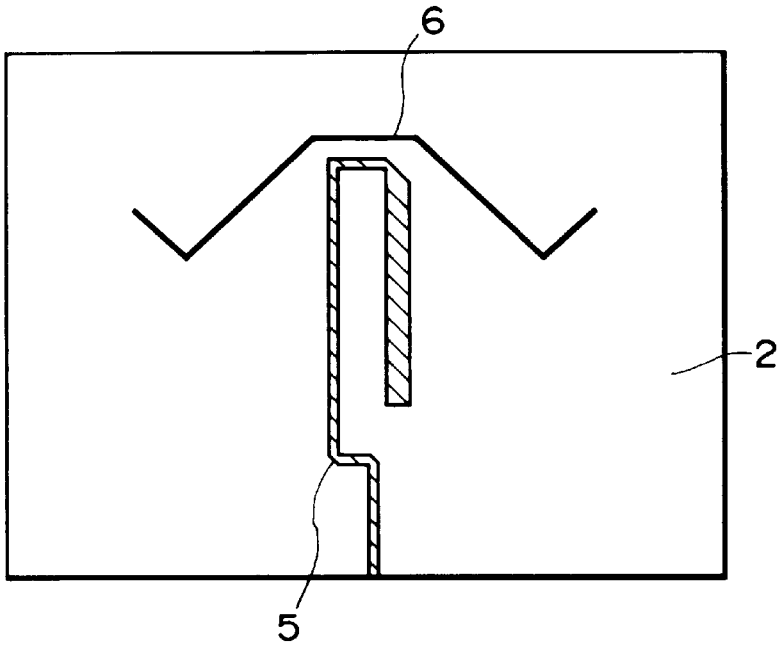

In the case of the parasitic elements 6 shown in FIGS. 6 to 11, shapes of the protruded portions formed at the central portion of parasitic element 6 resemble three sides of a trapezoid similar to the case of the parasitic element 6 shown in FIG. 2. However, the shapes at both ends of the parasitic element 6 are different from that in FIG. 2. The ends shown in FIG. 6 are upward concave with relatively large curvature. In the case of FIG. 7, the ends are of a curved shape upward convex having a relatively large curvature. In FIG. 8, the ends are like consecutive waves of relatively small curvature. In the case of FIG. 9, the ends are of a straight wedge shape.

Figure 10A:
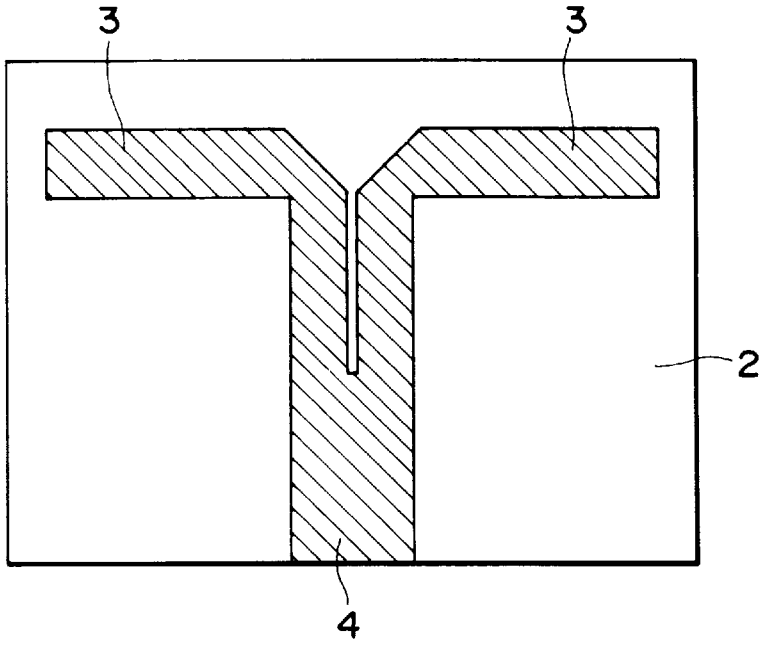
FIGS. 10(*a*) and 10(*b*) are essential portions of still another embodiment of the present invention.
Figure 10B:
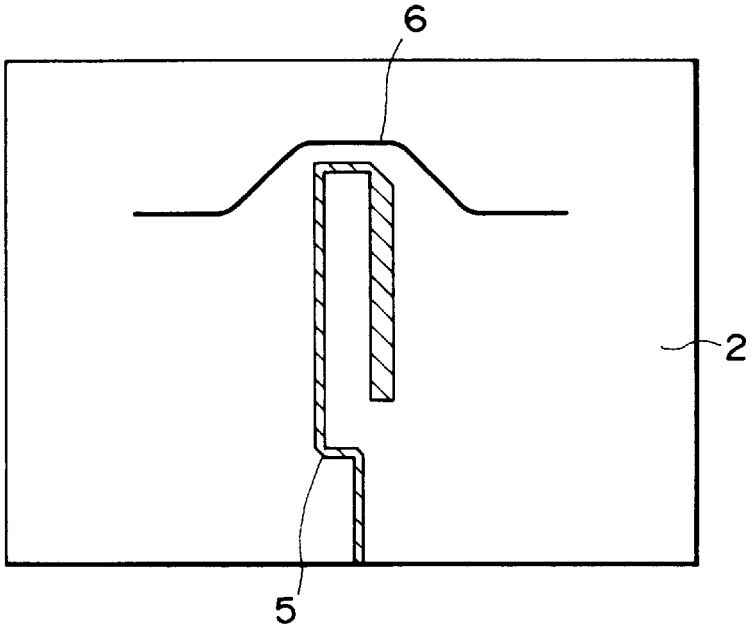

As shown in FIG. 10, it is possible to make all corners of the protruding portion of the parasitic element rounded.

Figure 11A:
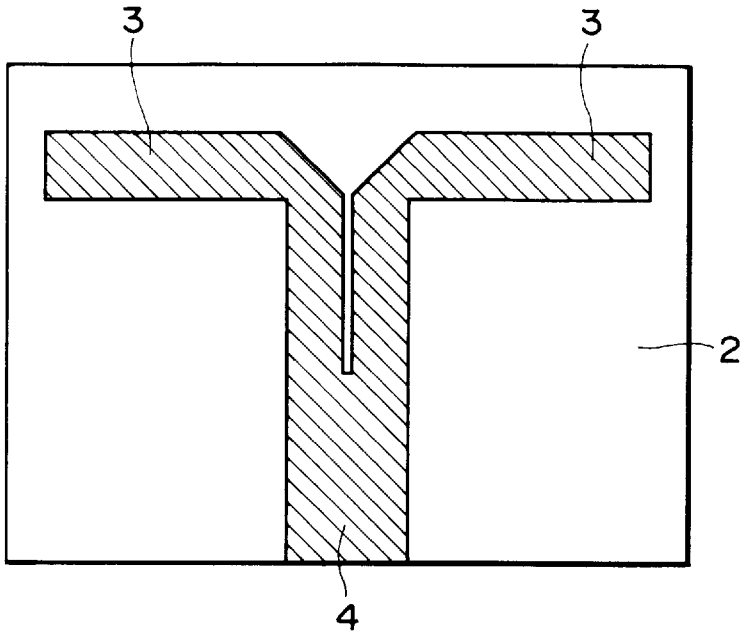
FIGS. 11(*a*) and 11(*b*) are essential portions of still another embodiment of the present invention.
Figure 11B:
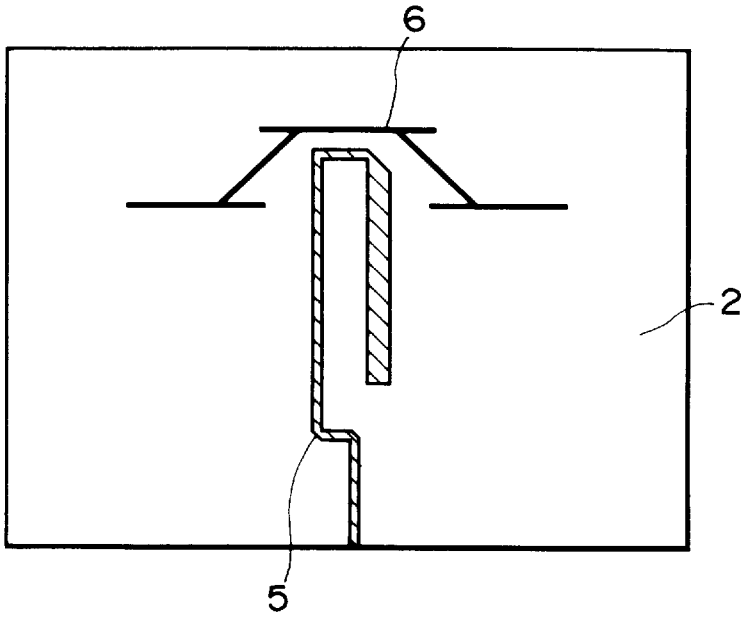

FIG. 11 shows a case of properly extending outward the ends of all elements of the parasitic element 6.

Figure 12A:
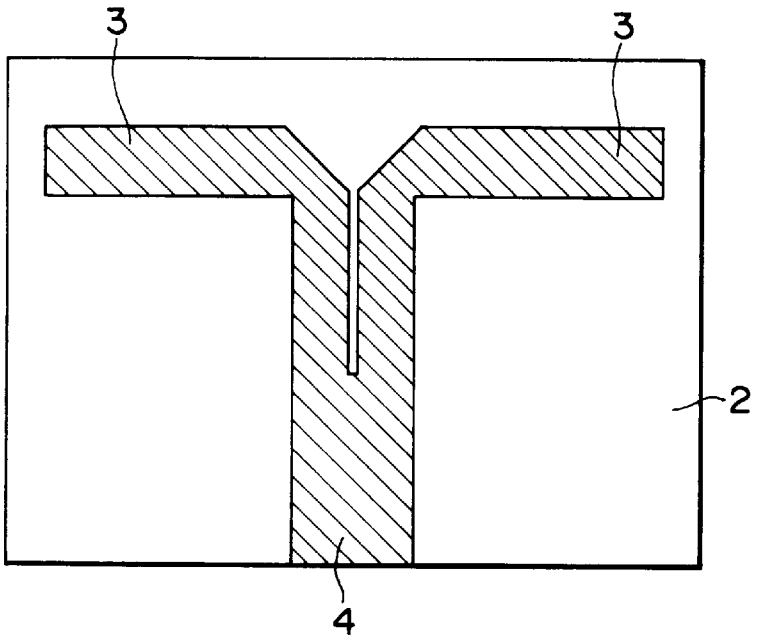
FIGS. 12(*a*) and 12(*b*) are essential portions of still another embodiment of the present invention.
Figure 12B:
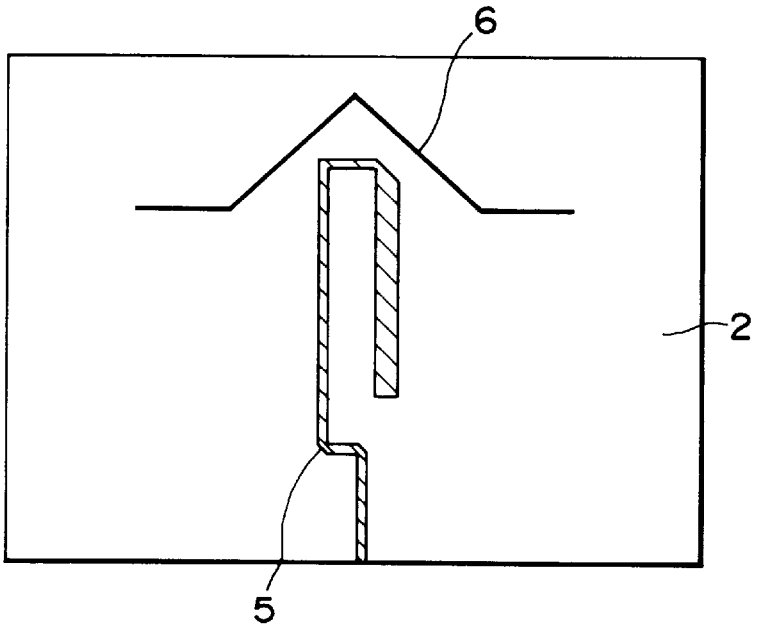

FIG. 12 shows a case of forming the central portion of the parasitic element 6 into a triangular shape and extending the both ends into straight lines. In the case of this embodiment, similarly to those of the embodiments in FIGS. 6 to 9, it is also possible to modify this embodiment by forming both ends into a curved shape having a relatively large curvature and concave or upward convex, consecutive waves with a relatively small curvature, or straight lines and making all corners of the parasitic element 6 sharp or rounded.

Figure 13A:
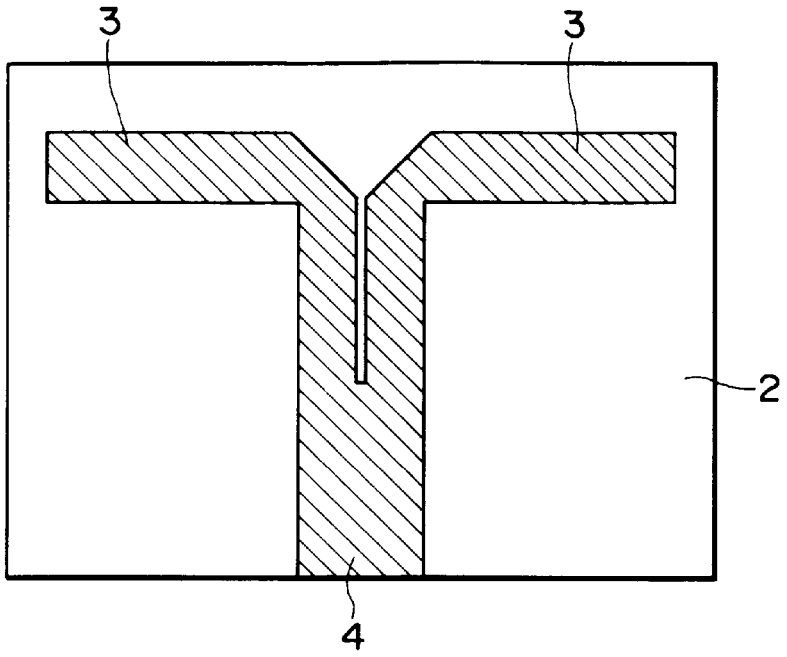
FIGS. 13(*a*) and 13(*b*) are essential portions of still another embodiment of the present invention.
Figure 13B:
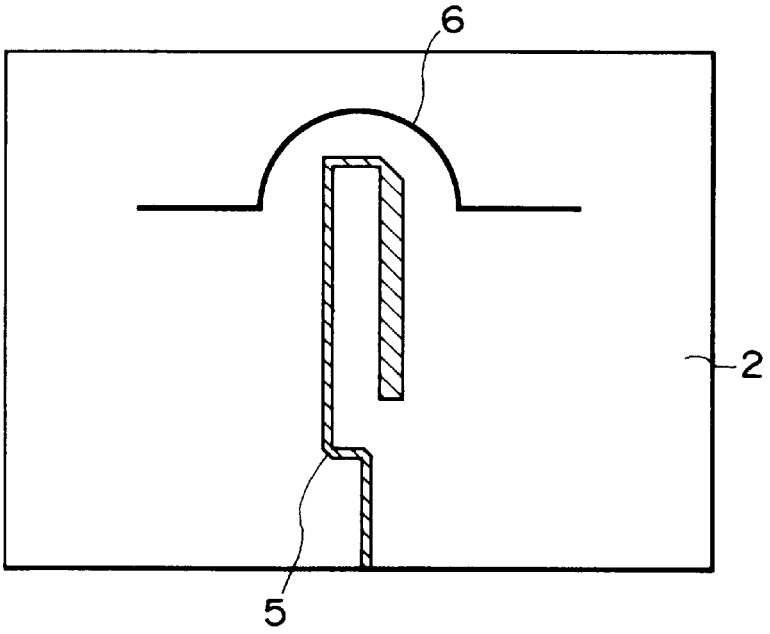

FIG. 13 shows a case of forming the central portion of the parasitic element 6 into semi-circular shape and forming both ends into a linear shape. This embodiment also makes it possible to embody the present invention by forming the both ends into a curved shape having a relatively large curvature and concave or upward convex, consecutive waves with a relatively small curvature or a linear wedge shape and making all corners of the parasitic element 6 sharp or rounded.

FIG. 14 shows a case of forming the central portion of the parasitic element 6 into an multiple straight lines approximating a circle and forming both ends into straight lines. In this embodiment it is also possible to embody the present invention by forming the both ends into a curved shape having a relatively large curvature, concave or upward convex, and a polygonal line, consecutive waves having a relatively small curvature and a polygonal line to make a waveform, or a linear wedge shape, and making all corners of the parasitic element 6 sharp or rounded.

FIG. 15 shows a case of forming the central portion of the parasitic element 6 into an almost rectangular shape and forming both ends into straight lines. This embodiment also makes it possible to embody the present invention by forming the both ends into a curved shape having a relatively large curvature and concave or upward convex, a consecutive wave shape having a relatively small curvature, or a linear wedge shape, and making all corners of the parasitic element 6 sharp or rounded.

Figure 16A:
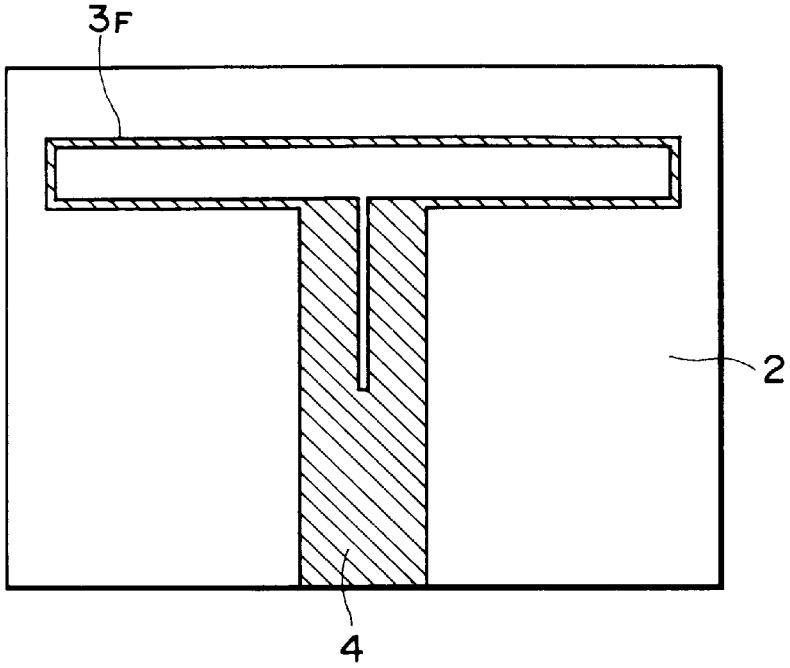
FIGS. 16(*a*) and 16(*b*) are essential portions of still another embodiment of the present invention.
Figure 16B:
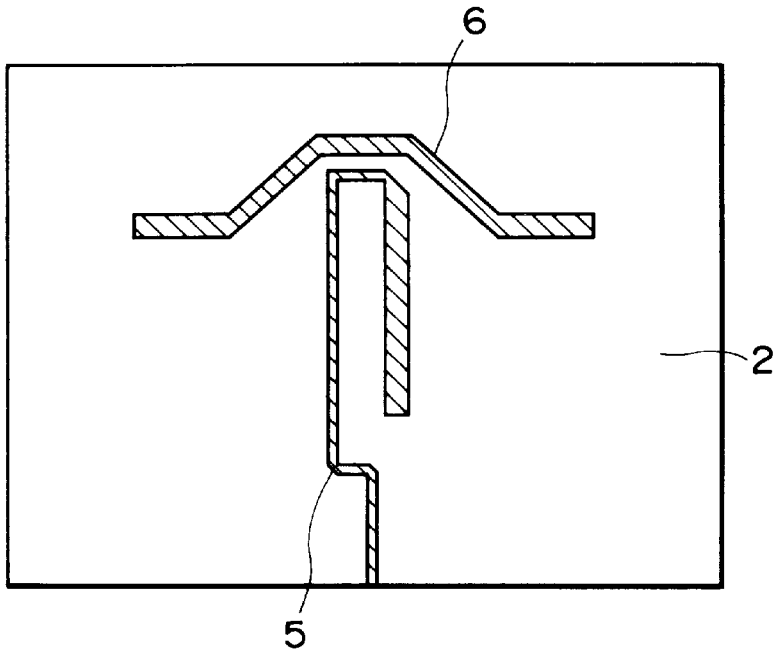

In the case of any of the embodiments described above, the function of the parasitic element 6 is the same as that of the parasitic element 6 shown in FIGS. 1 and 2. FIGS. 16(*a*) and 16(*b*) are also illustrations showing essential portions of another embodiment of the present invention, in which FIG. 16(*a*) shows the back (or face) side of one essential portion and FIG. 16(*b*) shows the face (or back) side of the other essential portion.

In the case of this embodiment, a dipole antenna is formed with a conductor $\mathbf{3}_F$ for forming a folded dipole antenna and its function is the same as that of the dipole antenna shown in FIGS. 1 and 2. In the case of the folded dipole antenna of this embodiment, however, it is possible to make the input impedance large compared to the case of the dipole antenna shown in FIGS. 1 and 2. Therefore, the structure using a folded dipole antenna is suitable for an antenna for constituting an array antenna to be described later.

In this embodiment it is also possible to embody the present invention by forming the parasitic element 6 into any one of the shapes described in FIGS. 6 to 15.

In FIG. 16, symbols and structures other than conductor $\mathbf{3}_F$ are the same as those in FIG. 2.

Figure 17:
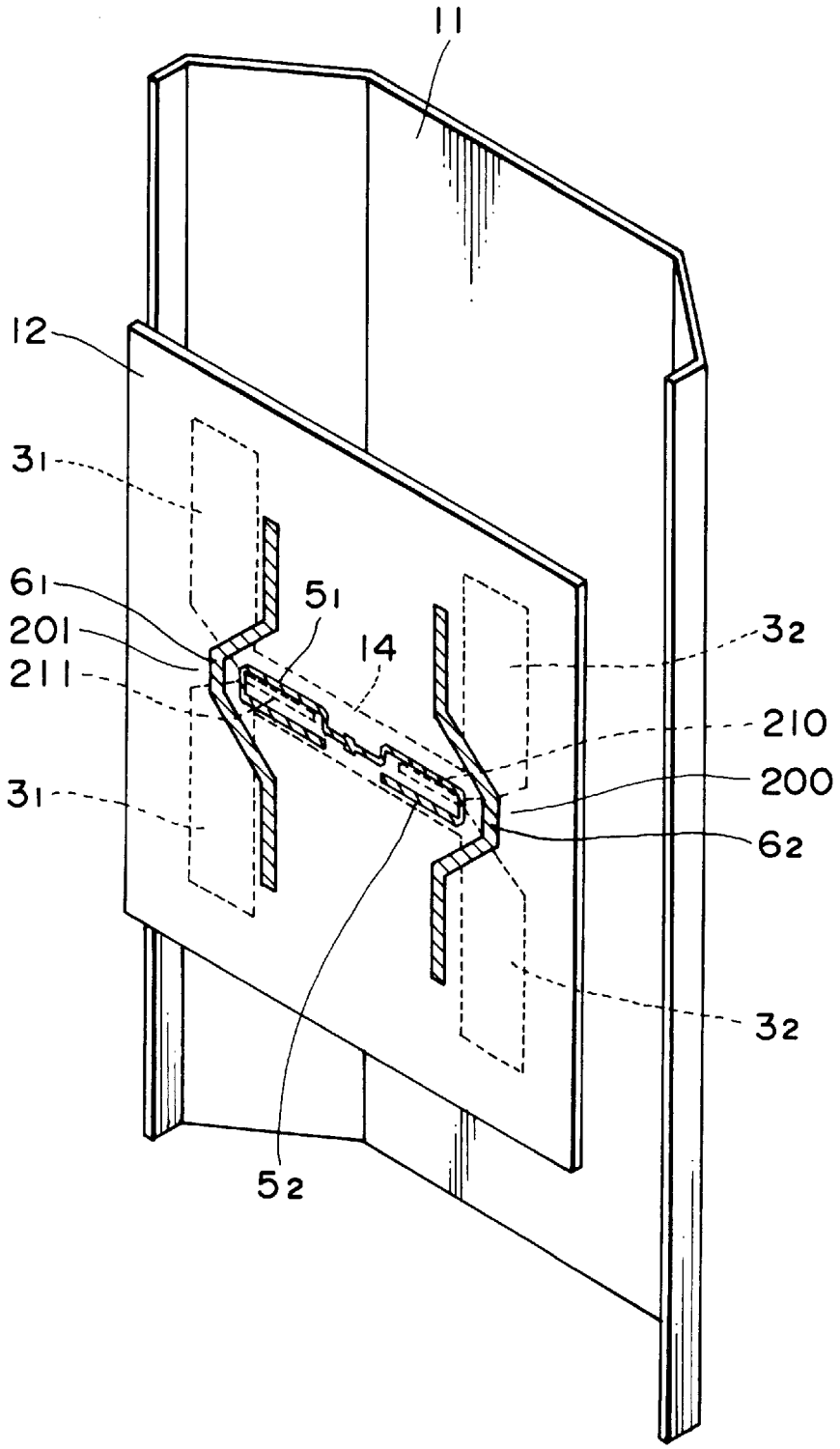
FIG. 17 is an array antenna comprising an antenna of the present invention.

FIG. 17 is a perspective view showing an array antenna comprising an antenna of the present invention, in which symbol 11 denotes a common reflector and 12 denotes a common dielectric substrate. In the case of this embodiment, the plane of the common dielectric substrate 12 is set so as to be parallel with the reflection surface of the common reflector 11.

To keep the parallel relation between the common reflector 11 and the common dielectric substrate 12, for example, a proper solid dielectric is inserted between the common reflector 11 and the common dielectric substrate 12 or the common reflector 11 and the common dielectric substrate 12 are united into one body by setting a spacer made of a proper material between them.

Then, symbols $\mathbf{3}_1$ and $\mathbf{3}_2$ denote conductors for forming first and second dipole antenna elements and 14 denotes a common earth conductor for forming a feed circuit. They are provided on the back (or face) side of the common dielectric substrate 12. The conductors $\mathbf{3}_1$ and $\mathbf{3}_2$ are provided symmetrically to the central point of the common dielectric substrate 12 and the center of the common earth conductor 14 is approximately set to the central point of the common dielectric substrate 12.

On the common earth conductor 14, longitudinal slots 210 and 211 are provided to which the vertices of notch 200 and 201 are mated. In other words, two substrates 2, on both of which a dipole antenna element is formed as show in FIG. 1, FIG. 2(*a*) and FIG. 2(*b*), are connected back-to-back. The two earth conductors 4 of each substrate 2 thus become a one-piece earth conductor 14.

The intersections of slot 210 and vertex 200, and slot 211 and vertex 201 are the feed points of the first dipole antenna element and the second dipole antenna element, respectively. Symbols $\mathbf{5}_1$ and $\mathbf{5}_2$ denote folded conductors for forming a feed circuit and $\mathbf{6}_1$ and $\mathbf{6}_2$ denote parasitic elements. They are provided on the face (or back) side of the common dielectric substrate 12 so as to be symmetric to the central point of the common dielectric substrate 12.

The folded conductor $\mathbf{5}_1$ forms a micro-strip line balance-unbalance conversion circuit (BALUN) associated with a part of the branch conductor formed by the divided portion of the earth conductor 14 provided on the back surface of the dielectric substrate 12.

The folded conductor $\mathbf{5}_2$ does the same function of BALUN with another part of the branch conductor formed by the divided portion of the earth conductor 14.

The parasitic elements $\mathbf{6}_1$ and $\mathbf{6}_2$ have the same shape as the parasitic element 6 shown in FIGS. 1 and 2. The mechanical arrangement relation between the conductor $\mathbf{3}_1$ for forming a dipole antenna element and parasitic element $\mathbf{6}_1$ and the mechanical arrangement relation between the conductor $\mathbf{3}_2$ for forming a dipole antenna element and parasitic element $\mathbf{6}_2$ are formed similarly to the mechanical arrangement relation between the conductor 3 for forming the dipole antenna element and parasitic element 6 in FIGS. 1 and 2. Though not shown in the figure, a coaxial connector is provided at the central portion of the back of the common dielectric substrate 12, the inner conductor of the coaxial connector is inserted into a hole provided on the common dielectric substrate 12 and connected to the middle point of the conductors $\mathbf{5}_1$ and $\mathbf{5}_2$ for forming the BALUN so that it is not electrically connected with the common earth conductor 14, and the outer conductor of the coaxial connector is connected to the common earth conductor 14.

Moreover, a coaxial cable connected to the coaxial connector is led to the back of the common reflector 11 through a hole provided at the central portion of the common reflector 11.

Figure 18:
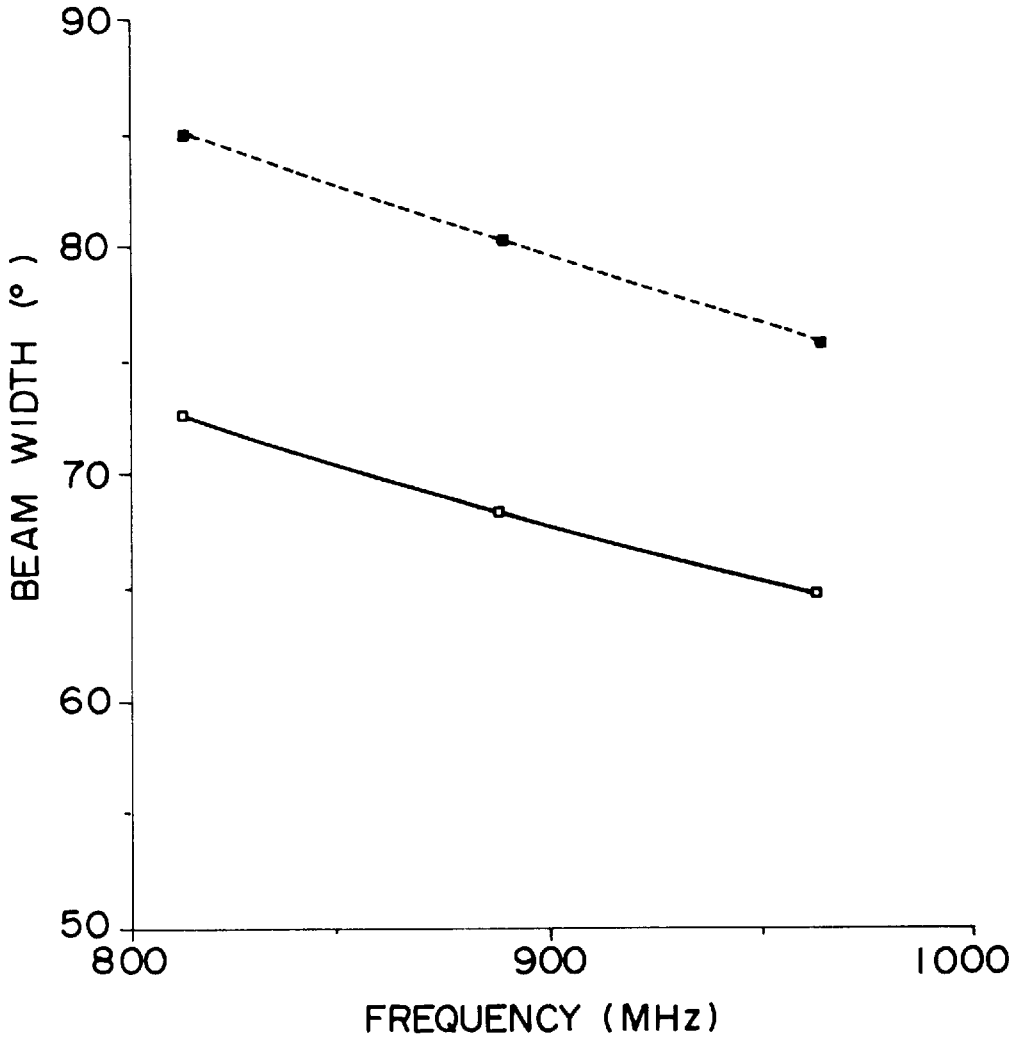
FIG. 18 is the frequency response of the beam width of an array antenna of the present invention.
Figure 20:
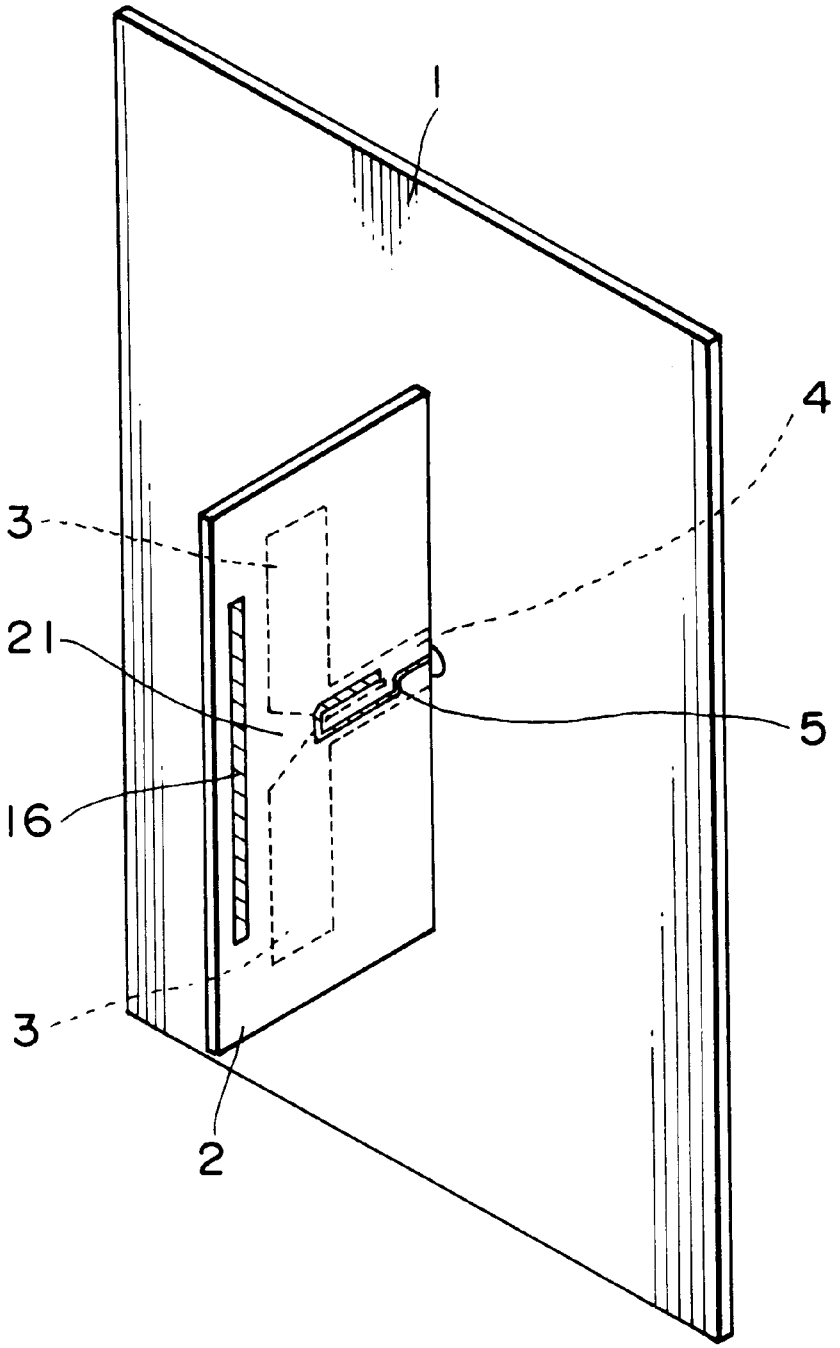
FIG. 20 is a conventional antenna.
Figure 21A:
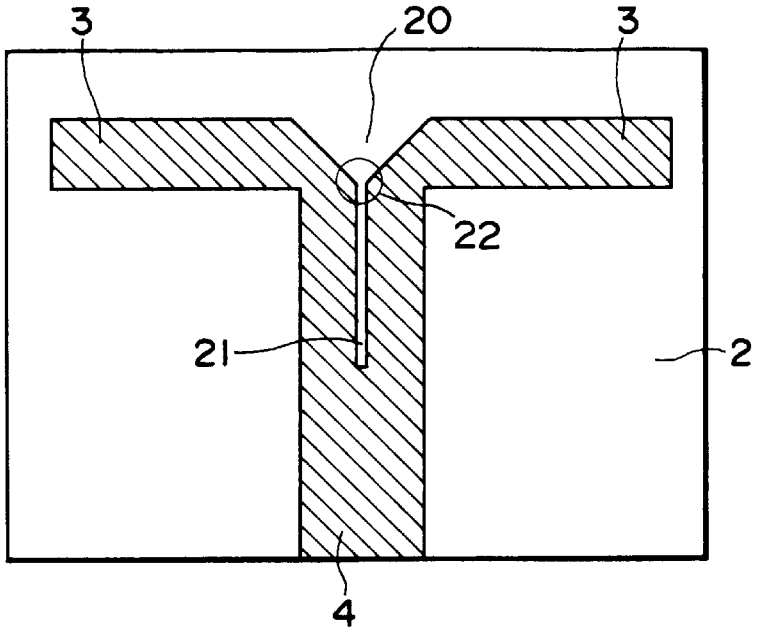
FIGS. 21(*a*) and 21(*b*) are essential portions of a conventional antenna.
Figure 21B:
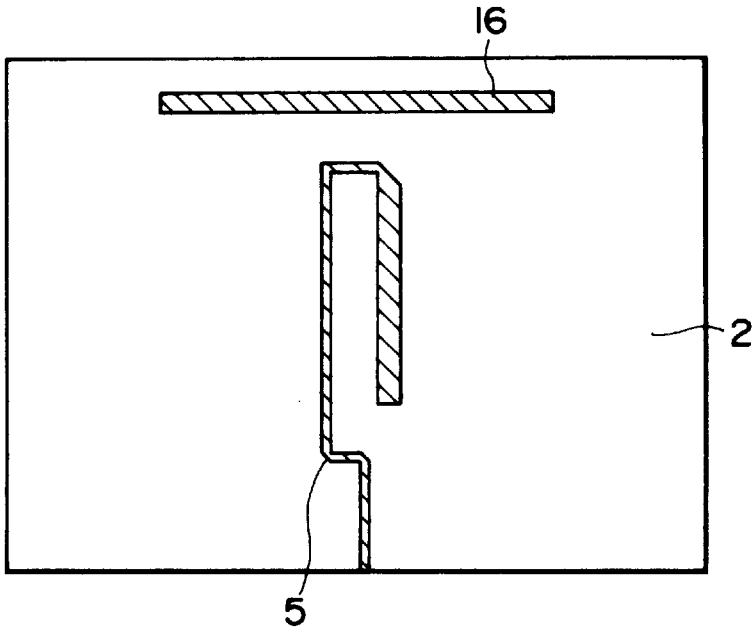
Figure 22:
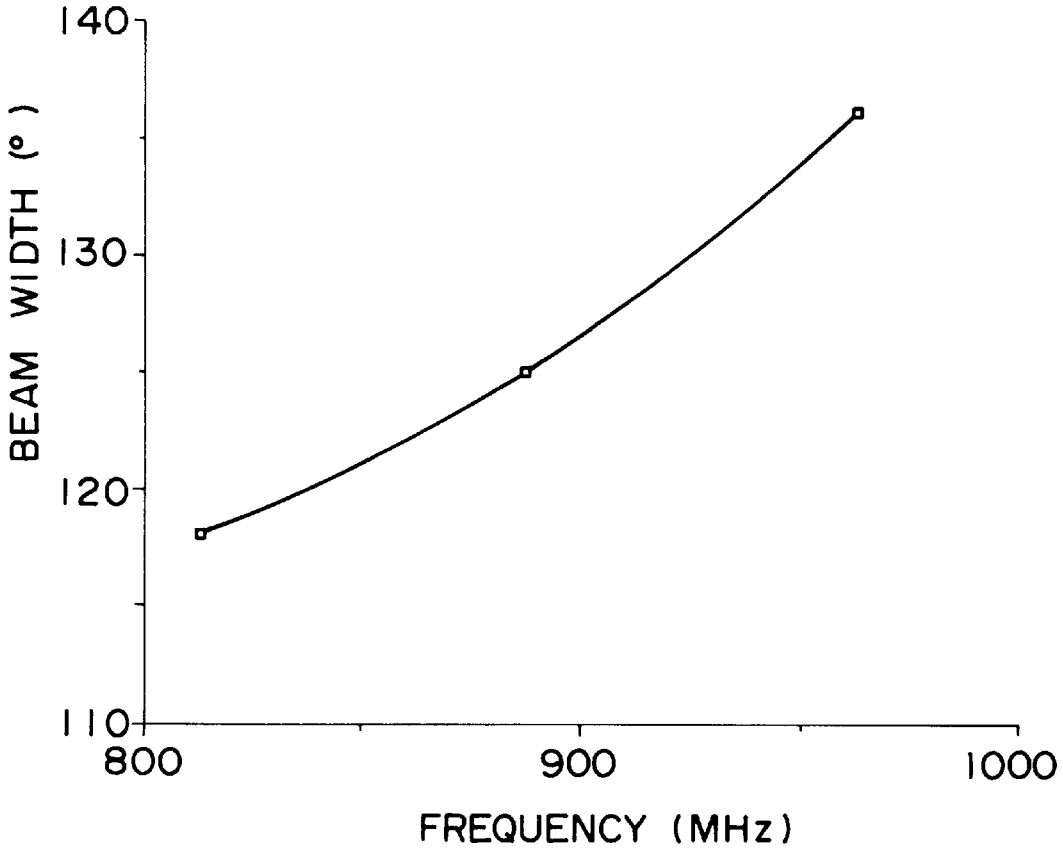
FIG. 22 is the frequency response of the beam width of a conventional antenna.

FIG. 18 is an illustration showing the frequency response of the beam width of the array antenna of the present invention shown in FIG. 17, in which x-axis and y-axis are the same as the case of FIG. 3, the solid line shows the response of the array antenna of the present invention shown in FIG. 17. The broken line shows the response of an array antenna obtained by replacing the parasitic elements $\mathbf{6}_1$ and $\mathbf{6}_2$ in FIG. 17 with linear parasitic elements having a length a little smaller than the length of a dipole antenna element, which is of the same configuration as a conventional reflector-provided antenna as shown in FIG. 20. In the case of the array antenna of the present invention (shown by the solid line), the beam width in a magnetic field plane is kept relatively narrow in a radiated frequency range of approximately 800 to approximately 960 MHz. In the case of the response shown by the broken line, however, the beam width in a magnetic field plane, is considerably increased in the same frequency range.

This is caused by the fact that the linear parasitic element provided in front of each dipole antenna element (outside of each dipole antenna element when viewed from the central point of dielectric substrate) serves as a director when the frequency of radiated wave is low, but serves as a reflector when the frequency of radiated wave is high, and in either case, the beam is narrowed in the plane parallel with the dielectric substrate.

That is, in a plane vertical to the dielectric substrate (magnetic field plane), there is a tendency that the beam becomes wider and the gain become lower. This trend becomes more prominent as the frequency lowers.

Even in the case of the array antenna of the present invention (shown by the solid line), the trends of wider beam width and lower gain exist. However, the trends of wider beam and lower gain are improved by setting the parasitic elements $\mathbf{6}_1$ and $\mathbf{6}_2$ inside of the dipole antenna elements $\mathbf{3}_1$ and $\mathbf{3}_2$, respectively.

In the case of an array antenna having the same shape and same setting position of a parasitic element as the conventional way, it is necessary to increase the area of the reflector and to increase the distance between the reflector and the dipole antenna element and the distance between dipole antenna elements in order to make the beam width and gain equal to those of an array antenna of the present invention. Therefore, it cannot be avoided that the entire size of an array antenna increases.

On the contrary, when it is permitted to keep the beam width and gain of an array antenna of the present invention equal to those of a conventional antenna, it is possible to decrease the entire size of the array antenna.

Figure 19:
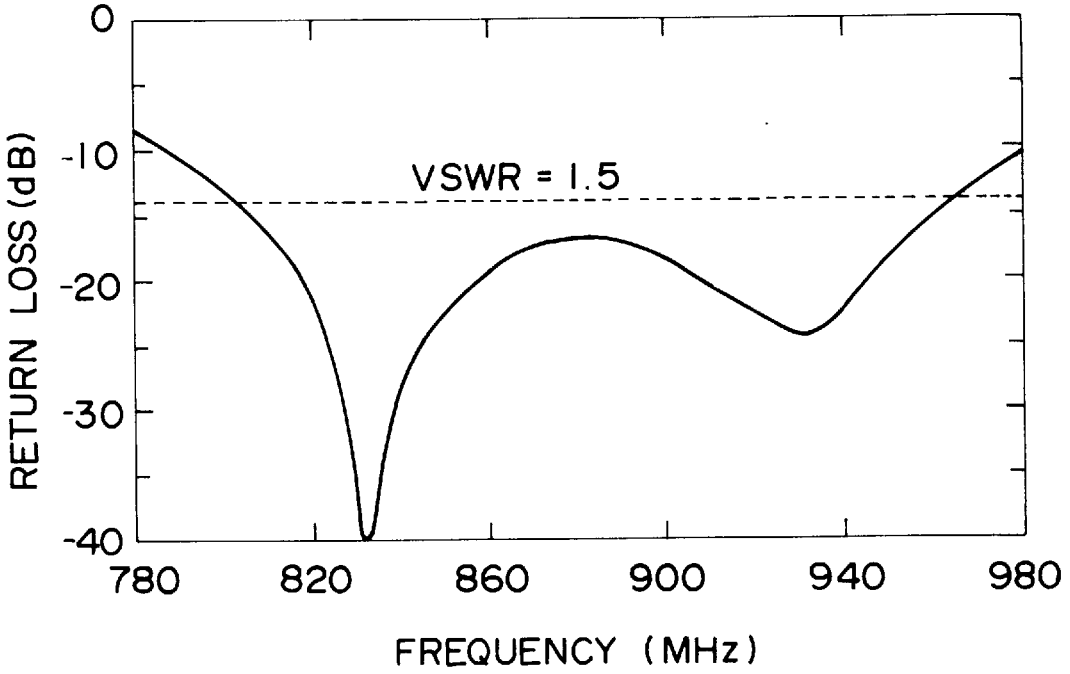
FIG. 19 is the frequency response of the return loss of an array antenna of the present invention.

FIG. 19 shows the result of measurement of return loss to illustrate the reflection characteristics of the array antenna of the present invention shown in FIG. 17 viewed from the coaxial connector (not shown though it is set to the back of the common dielectric substrate 12). The x-axis and y-axis are the same as the case of FIG. 4. From FIG. 19, it is found that a relative bandwidth is approximately 18% at the voltage standing wave ratio (VSWR) of approximately 1.5 or less and that the bandwidth is widened almost equally to the case of the antenna of the present invention shown in FIG. 1.

By arranging a proper number of array antennas of the present invention shown in FIG. 17 in the directions of electric field and magnetic field, it is possible to constitute an array antenna having a required radiation characteristics.

In the same manner, by arranging a proper number of antennas of the present invention shown in FIG. 1 in the direction of electric field and magnetic field, it is possible to constitute an array antenna having a required radiation characteristics. Furthermore, in the case of the antenna of the present invention shown in FIG. 1, it is possible to constitute an array antenna by setting another dielectric substrate same as the dielectric substrate 2 on the front surface of the reflector 1 in parallel with the dielectric substrate 2 at a proper separation and providing another antenna element same as the antenna element provided on the dielectric substrate 2 on the above dielectric substrate.

Also in the case of the array antenna of the present invention shown in FIG. 17, it is possible to replace the dipole antenna elements $\mathbf{3}_1$ and $\mathbf{3}_2$ with the folded dipole antenna element shown in FIG. 16 and the parasitic elements $\mathbf{6}_1$ and $\mathbf{6}_2$ with any one of the parasitic elements explained in FIGS. 6 to 15.

Because the reflector-provided dipole antenna of the present invention shows an outstanding performance over a wide frequency range and allows simultaneous transmission and reception at different frequencies, the antenna is suitable for a base station for mobile communication. Moreover, by folding and protruding the central portion of the parasitic element, it is possible to set the parasitic element at a position almost same as that of the dipole antenna element. For this reasons, particularly, when storing the antenna of the present invention shown in FIG. 1 in a cylindrical radome, it is possible to reduce the diameter of radome. Therefore, there is an advantage in selecting the site to install the antenna of the present invention, since it is not restricted by the size, weight and wind load.

While the present invention has been described above in connection with the preferred embodiments, one of ordinary skill in the art would be enabled by this disclosure to make various modifications to these embodiments and still be within the scope and spirit of the present invention as recited in the appended claims.

What is claimed is:

1. A reflector-provided dipole antenna comprising:

a dipole antenna element set to one side of a dielectric substrate provided at a reflector surface;

a feed circuit provided on said dielectric substrate; and a parasitic element provided on another side of said dielectric substrate, the parasitic element having a central portion and two end portions, wherein the central portion is positioned corresponding to a feed point of said dipole antenna element and has a protruding shape relative to the two end portions, and wherein the two end portions are positioned to the rear of said dipole antenna element.

2. The reflector-provided dipole antenna according to claim 1, wherein a plane defined by the dielectric substrate is perpendicular to the reflector surface.

3. The reflector-provided dipole antenna according to claim 1, wherein the plane defined by the dielectric substrate is parallel to the reflector surface.

4. A reflector-provided dipole antenna comprising:

multiple dielectric substrates provided at a common reflector surface, having planes perpendicular to said common reflector surface, and positioned parallel to one another at a predetermined separation;

a dipole antenna element provided at one side of each of said multiple dielectric substrates;

a feed circuit provided for each of said multiple dielectric substrates;

a parasitic element provided at another side of each of said multiple dielectric substrates, the parasitic element having a central portion and two end portions, wherein the central portion is positioned corresponding to the feed point of said dipole antenna element and has a protruding shape relative to the two end portions, and wherein the two end portions are positioned to the rear of said dipole antenna element; and a common feed circuit connected to each feed circuit provided for each of said multiple dielectric substrates.

5. A reflector-provided dipole antenna comprising:

a dielectric substrate provided for a front side of a common reflector, the plane of which is parallel with said reflector;

first and second dipole antenna elements arranged one each on one side of said dielectric substrate and being symmetrical to a center of said dielectric substrate;

first and second feed circuits, for the first and second dipole antenna elements, provided on said dielectric substrate;

first and second parasitic elements provided one each at another side of said dielectric substrate, said first and second parasitic elements each having a central portion and two end portions, wherein the central portion is positioned corresponding to a feed point of one of said dipole antenna elements and has a protruding shape relative to the two end portions, and wherein the two end portions are positioned to the rear of said one of said dipole antenna elements; and a common feed circuit connected to first and second feed circuits for said first and second dipole antenna elements.

6. The reflector-provided dipole antenna according to claim 1, wherein the protruding shape of the central portion resembles three sides of a trapezoid and the two ends are straight lines.

7. The reflector-provided dipole antenna according to claim 4, wherein the protruding shape of the central portion resembles three sides of a trapezoid and the two ends are straight lines.

8. The reflector-provided dipole antenna according to claim 5, wherein the protruding shape of the central portion resembles three sides of a trapezoid and the two ends are straight lines.

9. The reflector-provided dipole antenna according to claim 1, wherein the protruding shape of the central portion resembles three sides of a trapezoid and the two ends are curved.

10. The reflector-provided dipole antenna according to claim 4, wherein the protruding shape of the central portion resembles three sides of a trapezoid and the two ends are curved.

11. The reflector-provided dipole antenna according to claim 5, wherein the protruding shape of the central portion resembles three sides of a trapezoid and the two ends are curved.

12. The reflector-provided dipole antenna according to claim 1, wherein the protruding shape of the central portion resembles two sides of a triangle and the two ends are straight lines.

13. The reflector-provided dipole antenna according to claim 4, wherein the protruding shape of the central portion resembles two sides of a triangle and the two ends are straight lines.

14. The reflector-provided dipole antenna according to claim 5, wherein the protruding shape of the central portion resembles two sides of a triangle and the two ends are straight lines.

15. The reflector-provided dipole antenna according to claim 1, wherein the protruding shape of the central portion resembles two sides of a triangle and the two ends are curved.

16. The reflector-provided dipole antenna according to claim 4, wherein the protruding shape of the central portion resembles two sides of a triangle and the two ends are curved lines.

17. The reflector-provided dipole antenna according to claim 5, wherein the protruding shape of the central portion resembles two sides of a triangle and the two ends are curved lines.

18. The reflector-provided dipole antenna according to claim 1, wherein the protruding shape of the central portion resembles a semi-circle and the two ends are straight lines.

19. The reflector-provided dipole antenna according to claim 4, wherein the protruding shape of the central portion resembles a semi-circle and the two ends are straight lines.

20. The reflector-provided dipole antenna according to claim 5, wherein the protruding shape of the central portion resembles a semi-circle and the two ends are straight lines.

21. The reflector-provided dipole antenna according to claim 1, wherein the protruding shape of the central portion resembles a semi-circle and the two ends are curved.

22. The reflector-provided dipole antenna according to claim 4, wherein the protruding shape of the central portion resembles a semi-circle and the two ends are curved.

23. The reflector-provided dipole antenna according to claim 5, wherein the protruding shape of the central portion resembles a semi-circle and the two ends are curved.

24. The reflector-provided dipole antenna according to claim 1, wherein the protruding shape of the central portion is formed by a series of straight line segments approximating a semi-circle and the two ends are straight lines.

25. The reflector-provided dipole antenna according to claim 4, wherein the protruding shape of the central portion is formed by a series of straight line segments approximating a semi-circle and the two ends are straight lines.

26. The reflector-provided dipole antenna according to claim 5, wherein the protruding shape of the central portion is formed by a series of straight line segments approximating a semi-circle and the two ends are straight lines.

27. The reflector-provided dipole antenna according to claim 1, wherein the protruding shape of the central portion is formed by a series of straight line segments approximating a semi-circle and the two ends are curved.

28. The reflector-provided dipole antenna according to claim 4, wherein the protruding shape of the central portion is formed by a series of straight line segments approximating a semi-circle and the two ends are curved.

29. The reflector-provided dipole antenna according to claim 5, wherein the protruding shape of the central portion is formed by a series of straight line segments approximating a semi-circle and the two ends are curved.

30. The reflector-provided dipole antenna according to claim 1, wherein the protruding shape of the central portion resembles three sides of a rectangle and the two ends are straight lines.

31. The reflector-provided dipole antenna according to claim 4, wherein the protruding shape of the central portion resembles three sides of a rectangle and the two ends are straight lines.

32. The reflector-provided dipole antenna according to claim 5, wherein the protruding shape of the central portion resembles three sides of a rectangle and the two ends are straight lines.

33. The reflector-provided dipole antenna according to claim 1, wherein the protruding shape of the central portion resembles three sides of a rectangle and the two ends are curved.

34. The reflector-provided dipole antenna according to claim 4, wherein the protruding shape of the central portion resembles three sides of a rectangle and the two ends are curved.

35. The reflector-provided dipole antenna according to claim 5, wherein the protruding shape of the central portion resembles three sides of a rectangle and the two ends are curved.

* * * * *